US010236087B2

(12) United States Patent
Huang

(10) Patent No.: US 10,236,087 B2
(45) Date of Patent: Mar. 19, 2019

(54) REMOTE CONTROL PROTECTOR FOR ANTI-LIGHT INTERFERENCE

(71) Applicant: IR-TEC INTERNATIONAL LTD., Taoyuan (TW)

(72) Inventor: Wen-I Huang, Taoyuan (TW)

(73) Assignee: IR-Tec International Ltd., Taoyuan (TW)

( * ) Notice: Subject to any disclaimer, the term of this patent is extended or adjusted under 35 U.S.C. 154(b) by 0 days.

(21) Appl. No.: 15/292,382

(22) Filed: Oct. 13, 2016

(65) Prior Publication Data

US 2017/0365366 A1 Dec. 21, 2017

(30) Foreign Application Priority Data

Jun. 20, 2016 (TW) ..... 105119298 A

(51) Int. Cl.
*G21F 3/00* (2006.01)
*G21F 1/02* (2006.01)
*G08C 23/04* (2006.01)

(52) U.S. Cl.
CPC ..... *G21F 3/00* (2013.01); *G08C 23/04* (2013.01); *G21F 1/026* (2013.01)

(58) Field of Classification Search
None
See application file for complete search history.

(56) References Cited

U.S. PATENT DOCUMENTS

D448,761 S * 10/2001 Powell ..... D14/250
D459,346 S * 6/2002 Powell ..... D14/250
6,753,789 B1 * 6/2004 Batra ..... G08C 17/00 340/12.5
6,926,141 B2 * 8/2005 Montler ..... H01H 9/0242 206/320
D540,539 S * 4/2007 Gutierrez ..... D14/484.1
7,380,657 B2 * 6/2008 Yeh ..... A45C 11/00 206/320
D619,178 S * 7/2010 Ashida ..... D14/454
D631,098 S * 1/2011 Ashida ..... D14/454
8,215,483 B2 * 7/2012 Wakitani ..... A63F 13/02 206/305
9,432,125 B2 * 8/2016 Castano ..... G08C 23/04
2004/0137935 A1 7/2004 Zarom
(Continued)

FOREIGN PATENT DOCUMENTS

CN 2526922 Y 12/2002
CN 2729840 Y 9/2005
CN 2929855 Y 8/2007
(Continued)

*Primary Examiner* — Zhiyu Lu
(74) *Attorney, Agent, or Firm* — Rosenberg, Klein & Lee

(57) ABSTRACT

A remote control protector for anti-light interference includes a body and a shelter. The body includes a housing space, a first surface, and a second surface. The housing space is for disposing a remote control. The first surface includes a first opening communicating with the housing space. The second surface includes a second opening communicating with the housing space and the second opening is adapted to expose a transceiver of the remote control. The shelter extends from the second surface of the body along an axial direction of the body, surrounds the second surface, and has an outlet opening communicating with the second opening of the second surface.

15 Claims, 6 Drawing Sheets

(56) References Cited

U.S. PATENT DOCUMENTS

| | | | | |
|---|---|---|---|---|
| 2011/0235281 | A1* | 9/2011 | Mittleman | H04M 1/0202 361/728 |
| 2012/0273375 | A1* | 11/2012 | Rice | H04B 1/3888 206/320 |

FOREIGN PATENT DOCUMENTS

| | | | | |
|---|---|---|---|---|
| CN | 103837172 | A | 6/2014 | |
| CN | 104748767 | A | 7/2015 | |
| JP | 2002044766 | * | 2/2002 | H04Q 9/00 |

* cited by examiner

REMOTE CONTROL PROTECTOR FOR ANTI-LIGHT INTERFERENCE

BACKGROUND OF THE INVENTION

1. Field of the Invention

The present invention relates to a remote control protector, and more particularly to a remote control protector capable of anti-light interference.

2. Description of Related Art

Infrared ray (IR) is one of the common wireless communication techniques in the world and is implemented in most of the remote controls to control electronic devices, such as televisions, air conditioners, MP3 players, DVD players, and so on. The reason for IR transceiver being widely used in the remote control is that the IR transceiver has some advantages, such as small volume, low cost, low power consumption, and so on.

The IR is a kind of invisible light and there are many IRs existing in the living environment. For example, electronic devices may emit IR signals for communication, and the sun and many other objects, such as light bulbs and candles, may emit IRs. The IRs as environmental IRs emitted by the sun and the objects may affect the IR signals for the IR transceiver of the remote control and cause the communication error of the IR transceiver of the remote control. In addition, the IR signal received by the IR transceiver is easy to be interfered by the atmosphere. The flash and motion of the sun may also interrupt the IR signals. Moreover, many environmental factors, such as the sun light and atmosphere, and so on, may absorb energy from the IR to attenuate the performance of the IR signal when the IR transceiver receives the IR signal. Therefore, when the remote control is used under the sun, the remote control is easy to be affected.

However, the conventional remote control didn't include a protector to minimize the effect from the environmental IRs. It is necessary to design a protector for the conventional remote control to reduce the communication interruption from the environmental IRs.

SUMMARY OF THE INVENTION

An objective of the present invention is to provide a remote control protector for anti-light interference to reduce the communication interruption from the environmental IRs when the remote control is receiving the IR signal. The remote control protector of the present invention comprises a body and a shelter. The body includes a housing space, a first surface and a second surface. The housing space is for disposing a remote control. The first surface includes a first opening communicating with the housing space. The second surface includes a second opening communicating with the housing space and the second opening is adapted to expose a transceiver of the remote control. The shelter extends from the second surface of the body along an axial direction of the body, surrounds the second surface, and has an outlet opening communicating with the second opening of the second surface.

In order to achieve the aforementioned objective, the present invention also provides a remote control protector for anti-light interference that comprises a body and a shelter. The body comprises a housing space, a first surface, a second surface, a third opening, and a fourth opening. The housing space is for disposing a remote control. The first surface includes a first opening communicating with the housing space and the first surface is located at a top end of the body. The second surface includes a second opening communicating with the housing space and the second opening is located at a front end of the body. The third opening communicates with the housing space and the third opening is formed on a bottom end of the body, and the third opening is opposite to the first opening. The fourth opening communicates with the housing space and the fourth opening is formed at a rear end of the body and the fourth opening is opposite to the second opening. The shelter extends from the second surface of the body along an axial direction of the body, surrounds the second surface, and has an outlet opening communicating with the second opening of the second surface.

According to the aforementioned description, the remote control protector in the present invention includes a shelter to block the environmental IRs so as to prevent the interruption from the environmental IRs. Therefore, the communication error of the transceiver (such as IR transceiver) in the remote control mounted in the protector of the present invention can be minimized and the accuracy of the transceiver in the remote control of the present invention can be enhanced.

DETAILED DESCRIPTION OF THE PREFERRED EMBODIMENT

These and other aspects of the embodiments herein will be better appreciated and understood when considered in conjunction with the following description and the accompanying drawings.

Figure 1:
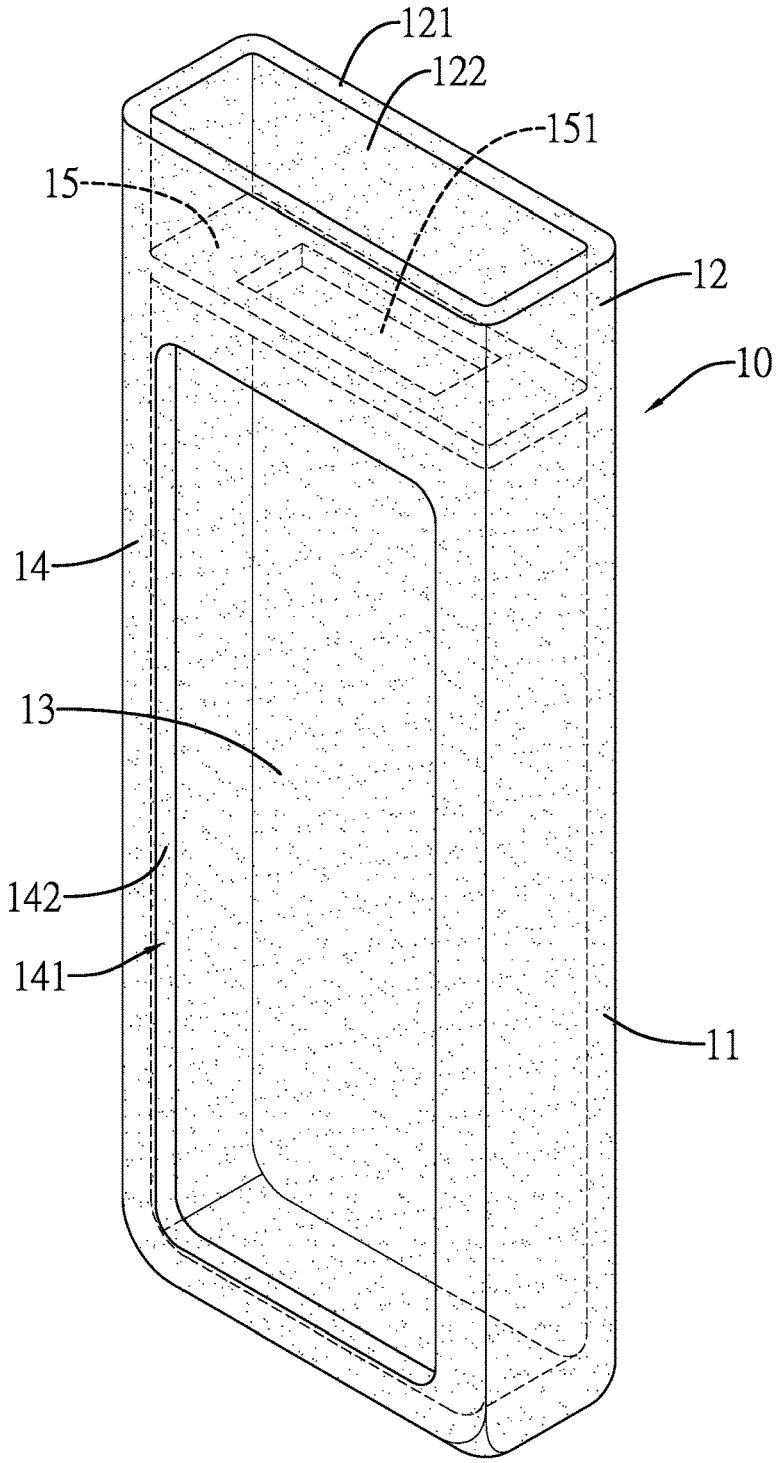
FIG. 1 is a perspective view of a remote control protector for anti-light interference in a first embodiment of the present invention.
Figure 2:
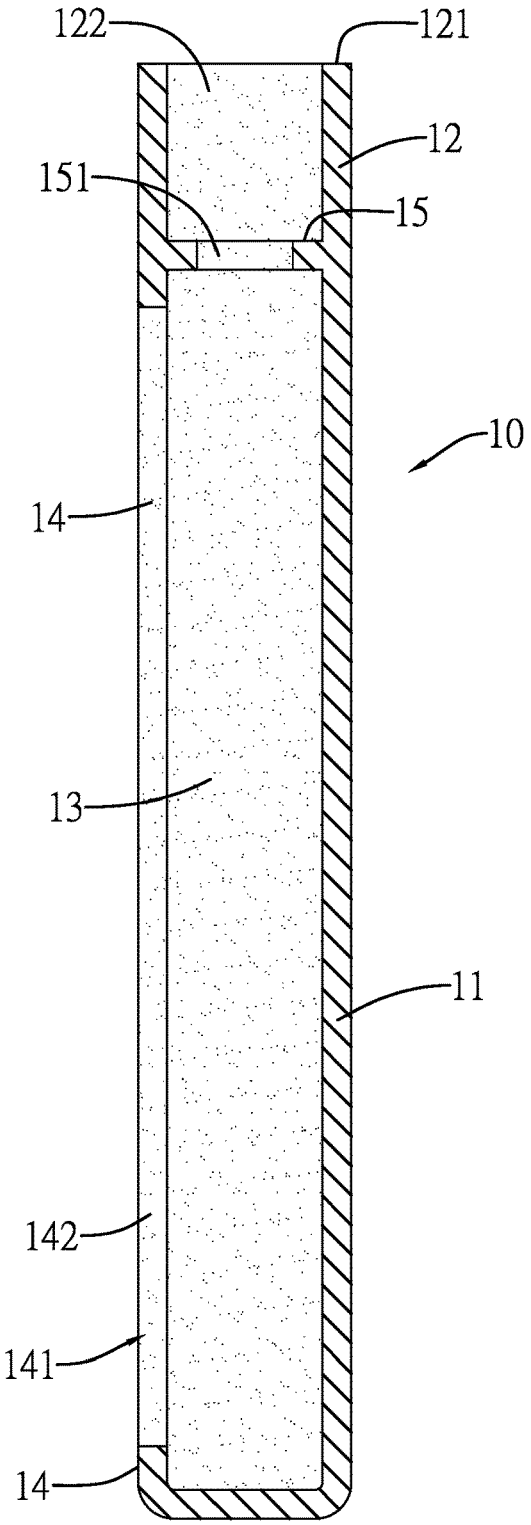
FIG. 2 is a cross-sectional view of the remote control protector for anti-light interference in the first embodiment of the present invention.
Figure 3:
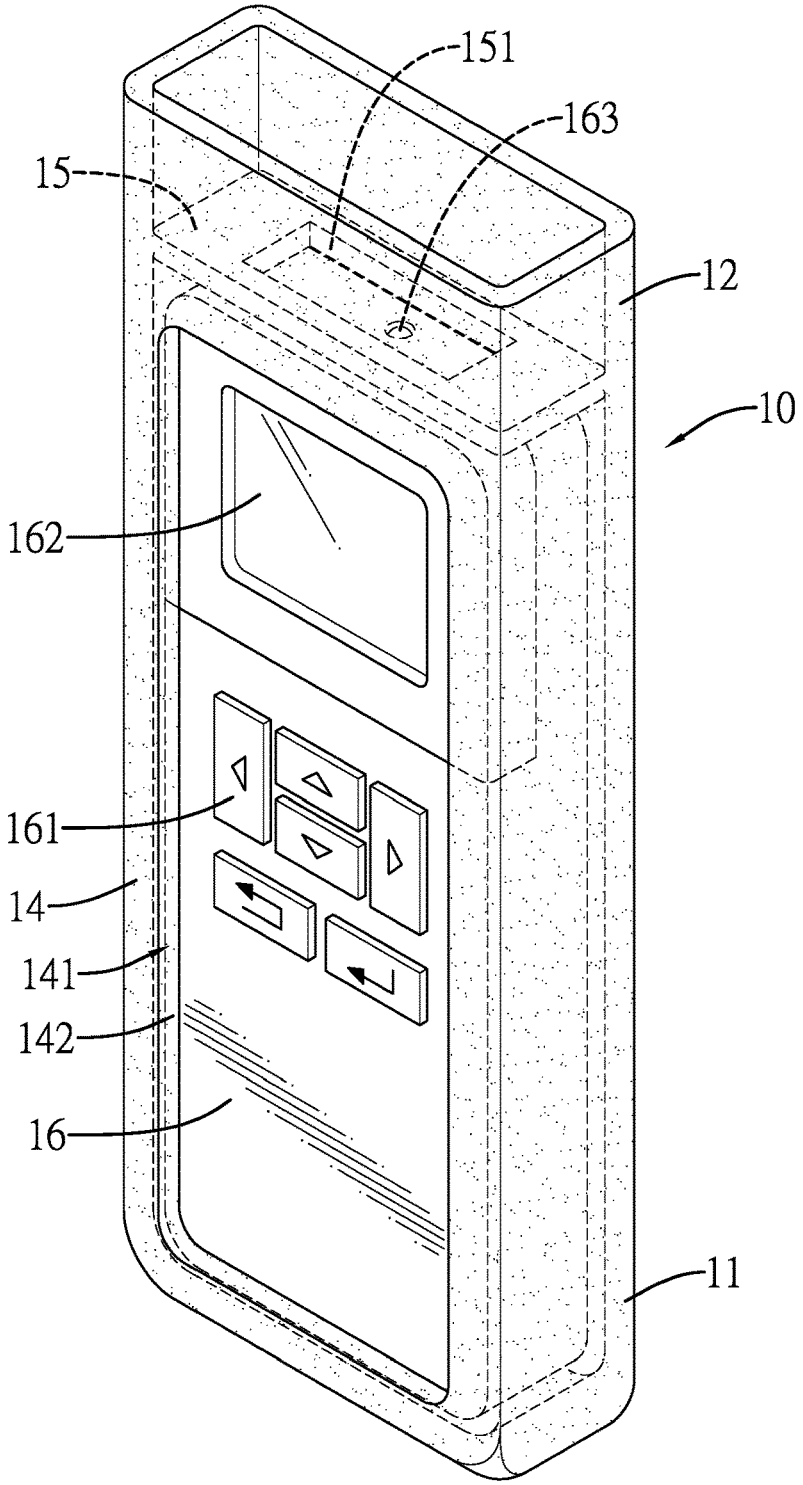
FIG. 3 is a perspective view of the remote control protector for anti-light interference combining with a remote control in the first embodiment of the present invention.

FIG. 1 is a perspective view of a remote control protector for anti-light interference in a first embodiment of the present invention. FIG. 2 is a cross-sectional view of the remote control protector for anti-light interference in the first embodiment of the present invention. FIG. 3 is a perspective view of the remote control protector for anti-light interference combining with a remote control in the first embodiment of the present invention. With reference to FIG. 1 and FIG. 2, the remote control protector 10 for anti-light interference includes a body 11 and a shelter 12. The remote control protector 10 may be made of silica gel. The body 11 and the shelter 12 are formed integratedly.

The body 11 is made of silica gel, such that the body 11 is elastic and deformable. The body 11 includes a housing space 13, a first surface 14, a first opening 141, a second surface 15, and a second opening 151. The first surface 14 of the body 11 is located at a top end of the body 11. The second surface 15 is located at a front end of the body 11 and is adjacent to the first surface 14.

The housing space 13 is formed in the body 11. The first opening 141 is formed within an inner edge 142 of the first surface 14 of the body 11 and communicates with the housing space 13. The width and the length of the first opening 141 are shorter than the width and the length of the housing space 13. The second opening 151 is formed within an inner edge of the second surface 15 and communicates with the housing space 13.

With reference to FIG. 3, the remote control protector 10 is configured to dispose a remote control 16. The remote control 16 may have multiple keypads 161 and a display monitor 162 on a top end thereof and a transceiver 163 on a front end thereof. The transceiver 163 in the embodiment of the present invention can be an IR transceiver. However, the transceiver 163 in a different embodiment of the present invention can be any optical transceiver or Bluetooth transceiver, and it is not limited herein. Because the body 11 is elastic and deformable, the remote control 16 may be put into the housing space 13 through the first opening 141, and the inner edge 142 of the first surface 14 would limit the position of the remote control 16 not to fall off from the body 11. The first opening 141 may expose the multiple keypads 161 and the display monitor 162, such that a user may operate the keypads 161 and watch the display monitor 162. The second opening 151 may expose the transceiver 163 of the remote control 16, such that the transceiver 163 can emit/receive IR signals and the IR signals travel through the second opening 151.

The shelter 12 extends from the second surface 15 of the body 11 along an axial direction of the body and surrounds the second surface 15. The shelter 12 includes a front end 121 and an outlet opening 122. The outlet opening 122 extends from the second surface 15 of the body 11 to the front end 121 of the shelter 12. The outlet opening 122 communicates with the second opening 151 and the exterior. In this embodiment, the width and the length of the outlet opening 122 may be longer than the width and the length of the second opening 151. The depth of the outlet opening 122 may be between 20 mm and 30 mm. In addition, the shelter 12 and the outlet opening 122 function as a lens hook for a digital lens reflex camera (DSLR) to block the environmental light. Without the lens hook, the environmental light will keep transmitting and reflecting between lenses in the DSLR and ghost images or poor images may be generated by the environmental light. Accordingly, when the shelter 12 and the outlet opening 122 are assembled in the body 11 of the remote control protector 10, the environmental IRs are efficiently blocked. Therefore, the signal transmission between the remote controller and a target is increased when the shelter 12 and the outlet opening 122 are assembled.

Hence, when the transceiver 163 of the remote control 16 emits/receives the IR signals, the IR signals may travel through the second opening 151 and the outlet opening 122. The shelter 12 works as a shield to block the environmental IRs interrupting the receiving path of the IR signals. As a result, the influence of the environmental IRs would be minimized. In other words, since the influence of the environmental IRs in the transceiver 163 is minimized, the transmission distance of the transceiver 163 is accordingly increased.

Figure 4:
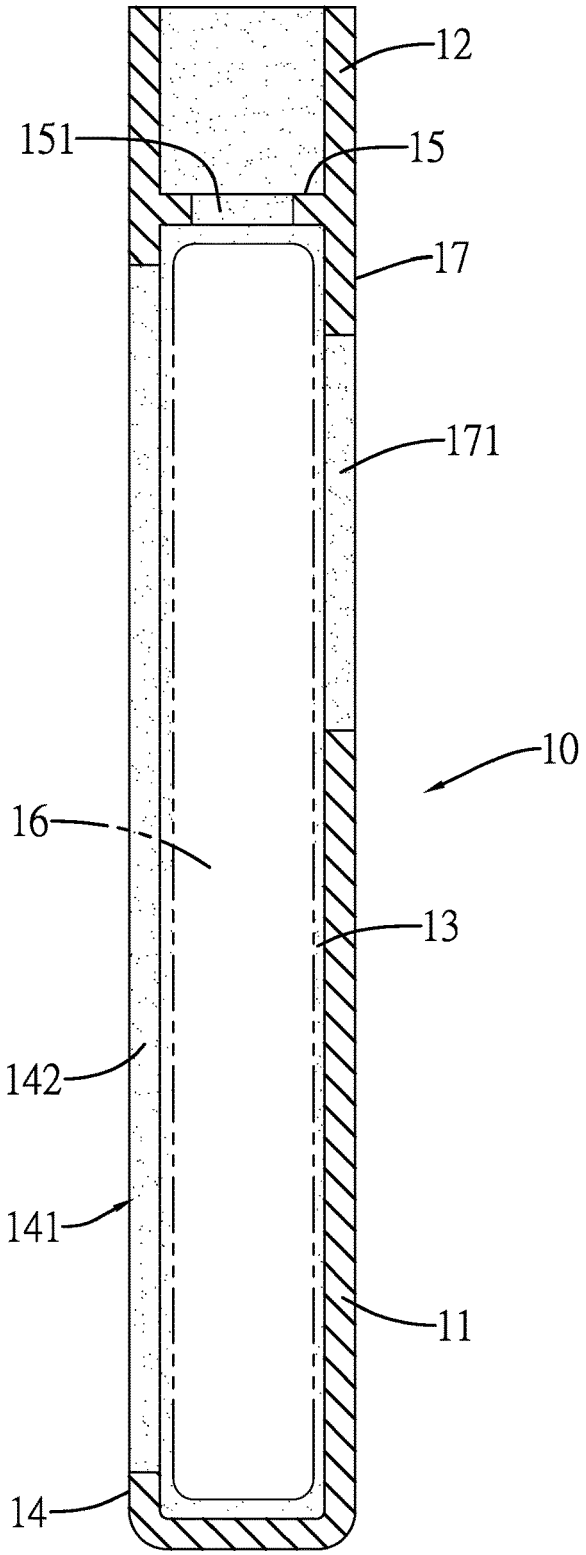
FIG. 4 is a cross-sectional view of the remote control protector for anti-light interference in a second embodiment of the present invention.

FIG. 4 is a cross-sectional view of the remote control protector 10 for anti-light interference in a second embodiment of the present invention. As shown in FIG. 4, compared with the first embodiment of the present invention, the body 11 of the second embodiment further includes a third opening 171. The third opening 171 is formed on a bottom end 17 of the body 11 and the third opening 171 is opposite to the first opening 141. The third opening 171 communicates with the housing space 13. Since the third opening 171 is located at the bottom surface of the body 11 and manufacture information, such as brand name, manufacture date, and so on, of the remote control 16 is also disposed at the bottom surface of the remote control 16, the third opening 171 may expose the manufacture information of the remote control 16.

Figure 5:
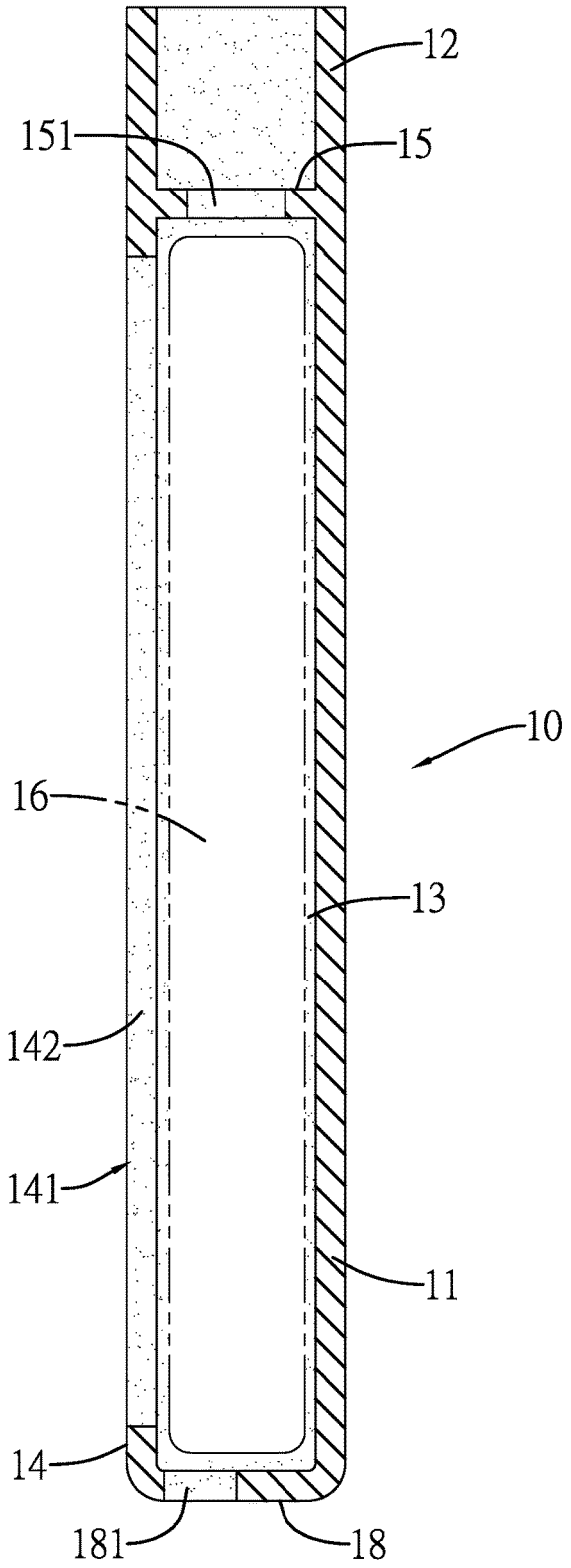
FIG. 5 is a cross-sectional view of the remote control protector for anti-light interference in a third embodiment of the present invention.

FIG. 5 is a cross-sectional view of the remote control protector 10 for anti-light interference in a third embodiment of the present invention. As shown in FIG. 5, compared with the first embodiment of the present invention, the body 11 of the third embodiment further includes a fourth opening 181. The fourth opening 181 is formed on a rear end 18 of the body 11 and communicates with the housing space 13. The fourth opening 181 is opposite to the position of the second opening 151. If the remote control 16 used in the present invention includes at least one connector (not shown) at the rear end of the remote control 16 and the connector is used to connect data transmission cable or power cable, such as USB cable, and so on, the fourth opening 181 may expose the connector of the remote control 16.

Figure 6:
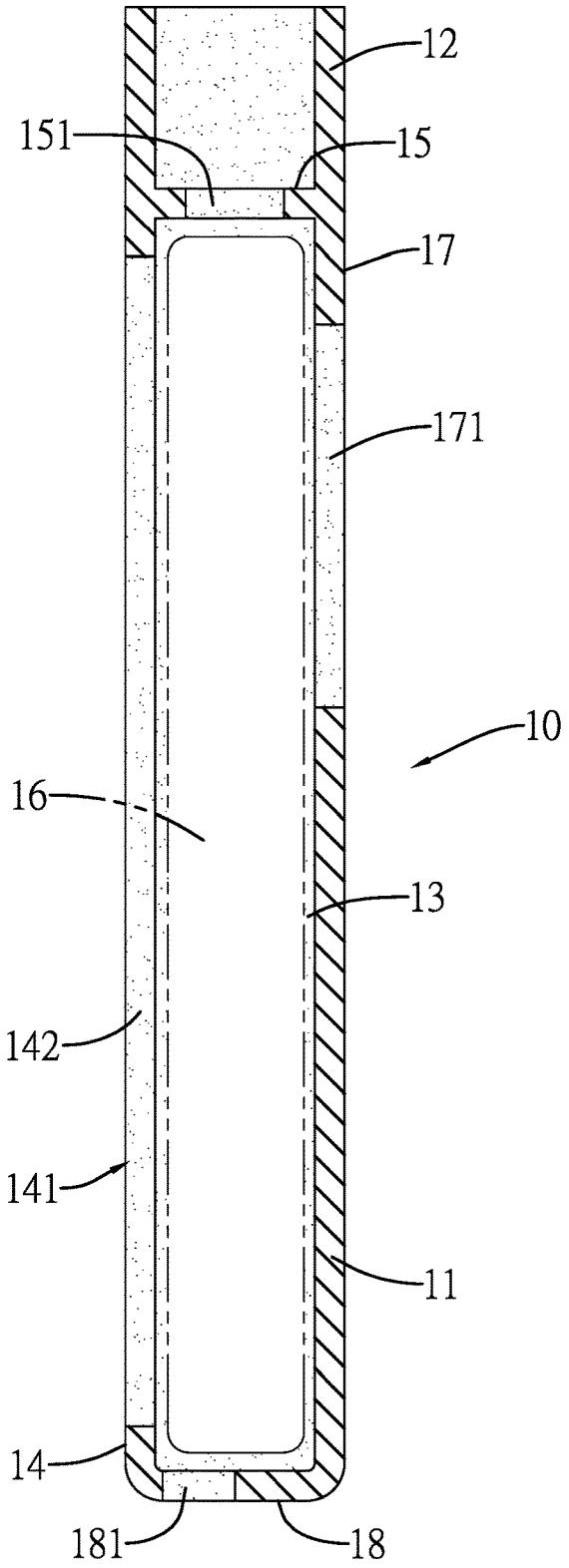
FIG. 6 is a cross-sectional view of the remote control protector for anti-light interference in a fourth embodiment of the present invention.

FIG. 6 is a cross-sectional view of the remote control protector 10 for anti-light interference in a fourth embodiment of the present invention. As shown in FIG. 6, compared with the first embodiment of the present invention, the body 11 of the fourth embodiment further includes the third opening 171 as disclosed in the second embodiment of the present invention and the fourth opening 181 in the third embodiment of the present invention.

Accordingly, by implementing the remote control protector for anti-light interference in the present invention, the influence of the environmental IRs to the IR received by the transceiver (such as IR transceiver) may reduce and the accuracy of the usage of the remote control may be enhanced.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A remote control protector for anti-light interference, comprising:

a body, comprising:

a housing space for disposing a remote control;

a first surface which is located at a top end of the body and includes the entire top end, further including a first opening communicating with the housing space; and a second surface which is adjacent to the first surface and is located at a front end of the body and includes the entire front end, further including a second opening communicating with the housing space and the second opening adapted to expose a transceiver of the remote control; and a shelter extending from the second surface of the body along an axial direction of the body, surrounding the second surface, and having an outlet opening communicating with the second opening of the second surface, wherein a depth of the outlet opening is between 20 mm and 30 mm, and the shelter blocking environmental infrared rays to prevent interruptions from the environmental infrared rays while simultaneously providing a large enough solid angle for signal infrared rays to sequentially enter the outlet opening, the second opening, and to be received by a sensor of the remote control enclosed in the body, thereby to balance the prevention of environmental infrared rays interruptions and the reception of the signal infrared rays.

2. The remote control protector as claimed in claim 1, wherein the first surface includes an inner edge and the first opening is formed within the inner edge.

3. The remote control protector as claimed in claim 1, wherein the body further has a third opening formed on a bottom end of the body, and the third opening is opposite to the first opening.

4. The remote control protector as claimed in claim 1, wherein the body has a fourth opening formed at a rear end of the body and the fourth opening is opposite to the second opening.

5. The remote control protector as claimed in claim 1, wherein the remote control protector is made of silica gel.

6. The remote control protector as claimed in claim 5, wherein the remote control protector is formed integratedly.

7. The remote control protector as claimed in claim 2, wherein the width and the length of the first opening are shorter than the width and the length of the housing space.

8. The remote control protector as claimed in claim 3, wherein the width and the length of the first opening are shorter than the width and the length of the housing space.

9. The remote control protector as claimed in claim 4, wherein the width and the length of the first opening are shorter than the width and the length of the housing space.

10. A remote control protector for anti-light interference, comprising:

a body, comprising:

a housing space for disposing a remote control;

a first surface which is located at a top end of the body and includes the entire top end, further including a first opening communicating with the housing space;

a second surface which is adjacent to the first surface and is located at a front end of the body and includes the entire front end, further including a second opening communicating with the housing space and the second opening located at the front end of the body;

a third opening communicating with the housing space and the third opening formed on a bottom end of the body, and the third opening opposite to the first opening; and a fourth opening communicating with the housing space and the fourth opening formed at a rear end of the body and the fourth opening opposite to the second opening; and a shelter extending from the second surface of the body along an axial direction of the body, surrounding the second surface, and having an outlet opening communicating with the second opening of the second surface, wherein a depth of the outlet opening is between 20 mm and 30 mm; and the shelter blocking environmental infrared rays to prevent interruptions from the environmental infrared rays while simultaneously providing a large enough solid angle for signal infrared rays to sequentially enter the outlet opening, the second opening, and to be received by a sensor of the remote control enclosed in the body, thereby to balance the prevention of the environmental infrared rays interruptions and the reception of the signal infrared rays.

11. The remote control protector as claimed in claim 10, wherein the first surface includes an inner edge and the first opening is formed within the inner edge.

12. The remote control protector as claimed in claim 11, wherein the remote control protector is made of silica gel.

13. The remote control protector as claimed in claim 12, wherein the remote control protector is formed integratedly.

14. The remote control protector as claimed in claim 10, wherein the width and the length of the first opening are shorter than the width and the length of the housing space.

15. The remote control protector as claimed in claim 11, wherein the width and the length of the first opening are shorter than the width and the length of the housing space.

* * * * *